US008162316B2

(12) United States Patent
Andersen

(10) Patent No.: US 8,162,316 B2
(45) Date of Patent: Apr. 24, 2012

(54) GAME SYSTEM AND DEVICE FOR PROJECTING GAME INFORMATION ONTO A SURFACE

(75) Inventor: Jacob Ranis Stokholm Andersen, Hong Kong (CN)

(73) Assignee: Home Focus Development Ltd, Road Town, Tortola (VG)

( * ) Notice: Subject to any disclaimer, the term of this patent is extended or adjusted under 35 U.S.C. 154(b) by 444 days.

(21) Appl. No.: 12/365,479

(22) Filed: Feb. 4, 2009

(65) Prior Publication Data

US 2010/0197195 A1 Aug. 5, 2010

(51) Int. Cl.
*A63F 13/00* (2006.01)

(52) U.S. Cl. ..... 273/138.2; 273/138.1; 273/139; 273/288; 463/16; 446/226; 446/268; 446/368; 446/485

(58) Field of Classification Search ..... 273/138.2, 273/139, 138.1, 287, 249, 288, 142 A; 463/16; 446/226, 219, 485, 268, 368
See application file for complete search history.

(56) References Cited

U.S. PATENT DOCUMENTS

| | | | | |
|---|---|---|---|---|
| 3,734,509 | A * | 5/1973 | Glass et al. | 273/139 |
| 4,781,378 | A * | 11/1988 | Clinnin et al. | 273/287 |
| 5,316,308 | A * | 5/1994 | Stembokas | 273/249 |
| 5,545,072 | A * | 8/1996 | Arad et al. | 446/268 |
| 5,984,367 | A * | 11/1999 | Barnhart et al. | 283/92 |
| 2005/0068571 | A1 * | 3/2005 | Hart et al. | 358/1.15 |

* cited by examiner

*Primary Examiner* — Benjamin Layno
(74) *Attorney, Agent, or Firm* — Volpe and Koenig P.C.

(57) ABSTRACT

A game system is provided that includes at least one game device and at least one game piece. The game piece includes game information, which is not readily legible to the naked eye, and is projected onto a game surface. A device is also provided for playing a game that is configured to receive a game piece that is at least semi-transparent and contains information thereon not readily legible to the naked eye. Also provided is a game piece that is at least semi-transparent that includes game information that is not readily legible by the human eye that is insertable in a game device for projecting or viewing the game information. A figurine is also provided that includes a plurality of semi-transparent game pieces containing indicia or images thereon. The figurine also includes a rotatable portion and an aperture configured for viewing or projecting the indicia or images.

14 Claims, 7 Drawing Sheets

GAME SYSTEM AND DEVICE FOR PROJECTING GAME INFORMATION ONTO A SURFACE

FIELD OF INVENTION

The invention relates to the field of interactive game play. For example, collectable card games, or role play games involving action figures.

BACKGROUND

Action figures, collectable card games, role playing games and trading cards are very popular toys. Recently, developers have created better and more complex game play and associated features into these toys. These features have been developed due to the technical development and increasing demand of these features by children who have become used to playing complex computer games or handheld games, etc.

SUMMARY

The present disclosure is directed to a game system that includes at least one game device and at least one game piece. The game piece includes game information, which is not readily legible to the naked eye, and is projected onto a game surface.

The present disclosure is also directed to a device for playing a game that is configured to receive a game piece that is at least semi-transparent and contains information thereon that is not readily legible to the naked eye.

The present disclosure is further directed to a game piece that is at least semi-transparent that includes game information that is not readily legible by the human eye that is insertable in a game device for projecting or viewing the game information.

The present disclosure is also directed to a figurine including a plurality of semi-transparent game pieces that contains indicia or images thereon. The figurine also includes a rotatable portion and an aperture configured for viewing or projecting the indicia or images.

DETAILED DESCRIPTION OF THE PREFERRED EMBODIMENTS

Figure 1:
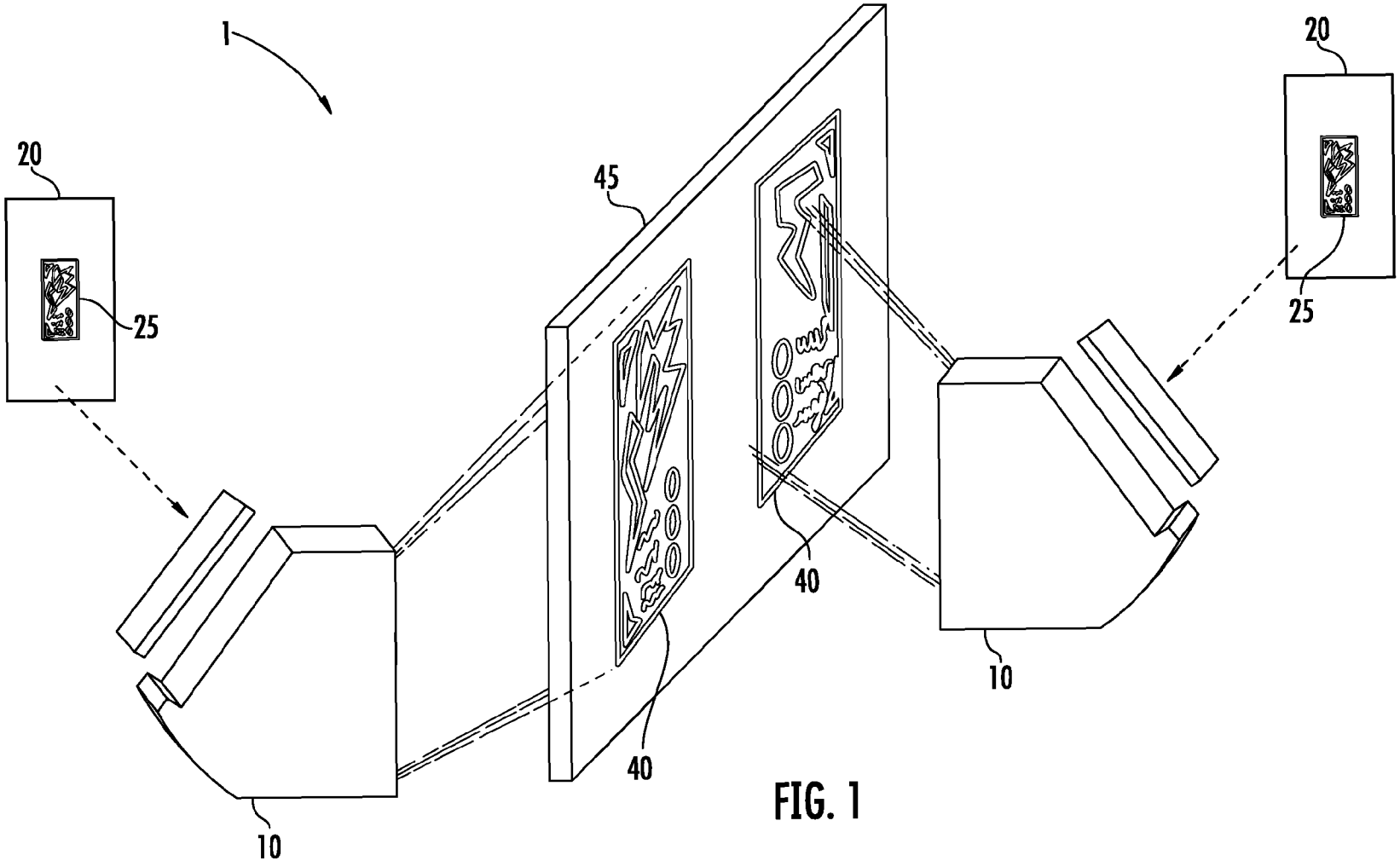
FIG. 1 is a schematic representation of the game system of the present disclosure.

As shown in FIG. 1, a game system 1 is provided. The game system 1 includes a display device 10 and a game piece 20. A projection surface 45 is provided which has game information projected thereon 40. In the representation shown in FIG. 1, there are two devices 10 and one projection surface 45. The game pieces 20 contain indicia or images 25 which are not readily legible to the naked eye. The indicia or images can be printed on a small scale, for example, as in micro film and contain symbols, alphanumerical characters, game commands, instructions on how to proceed in the game, etc.

Figure 2B:
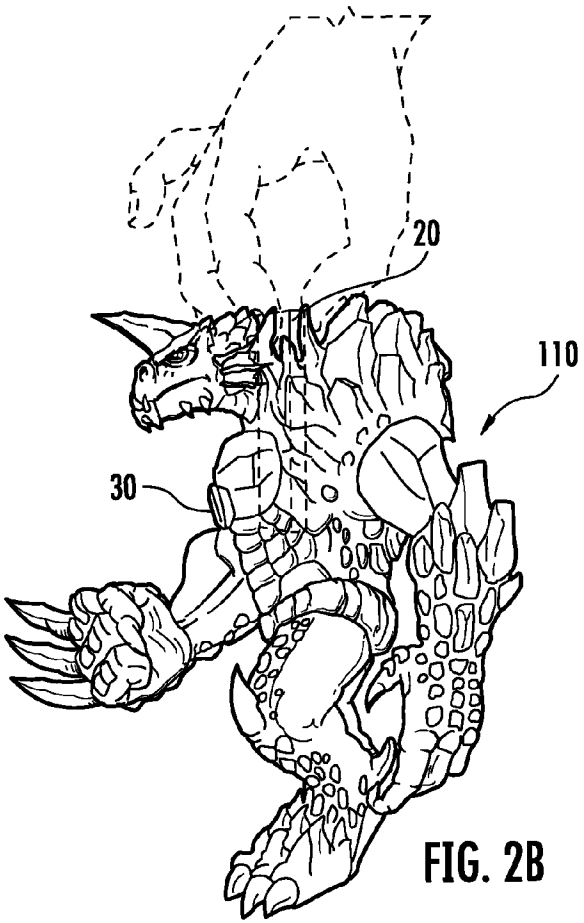
FIGS. 2*a*, 2*b* are representations of the game system in use.
Figure 2A:
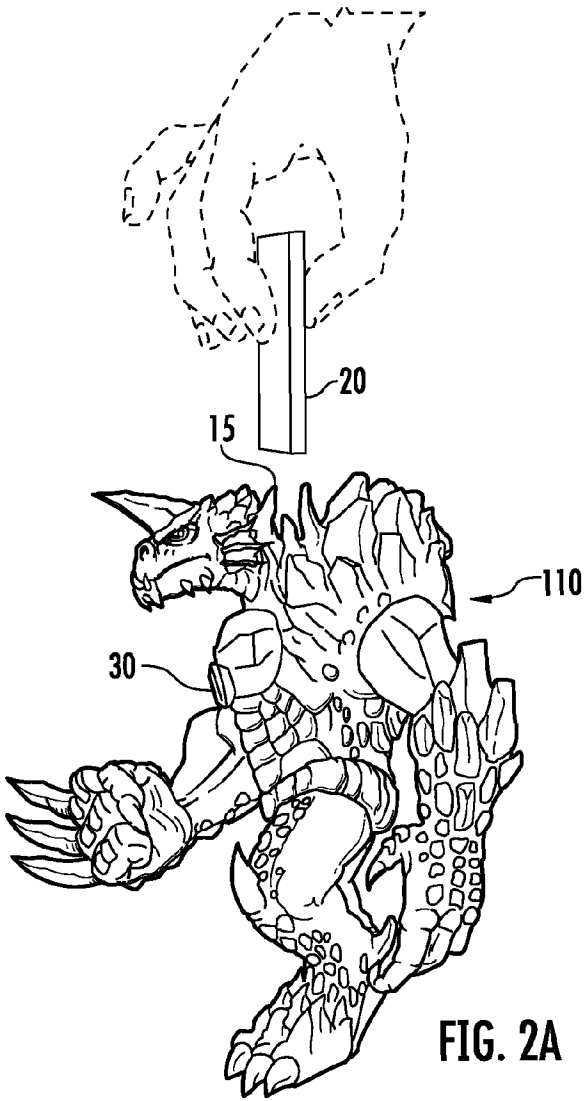
Figure 2D:
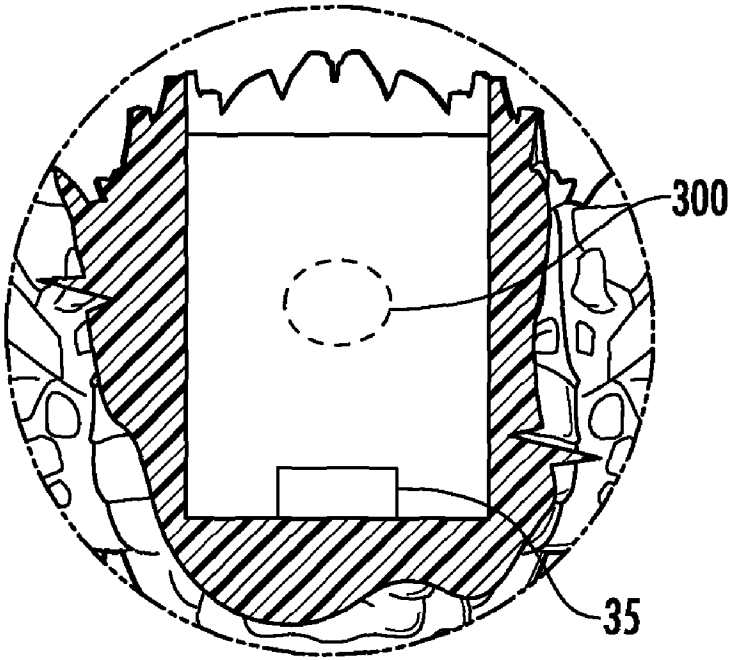
FIG. 2*d* is a detail of a portion of FIG. 2*c*.
Figure 2C:
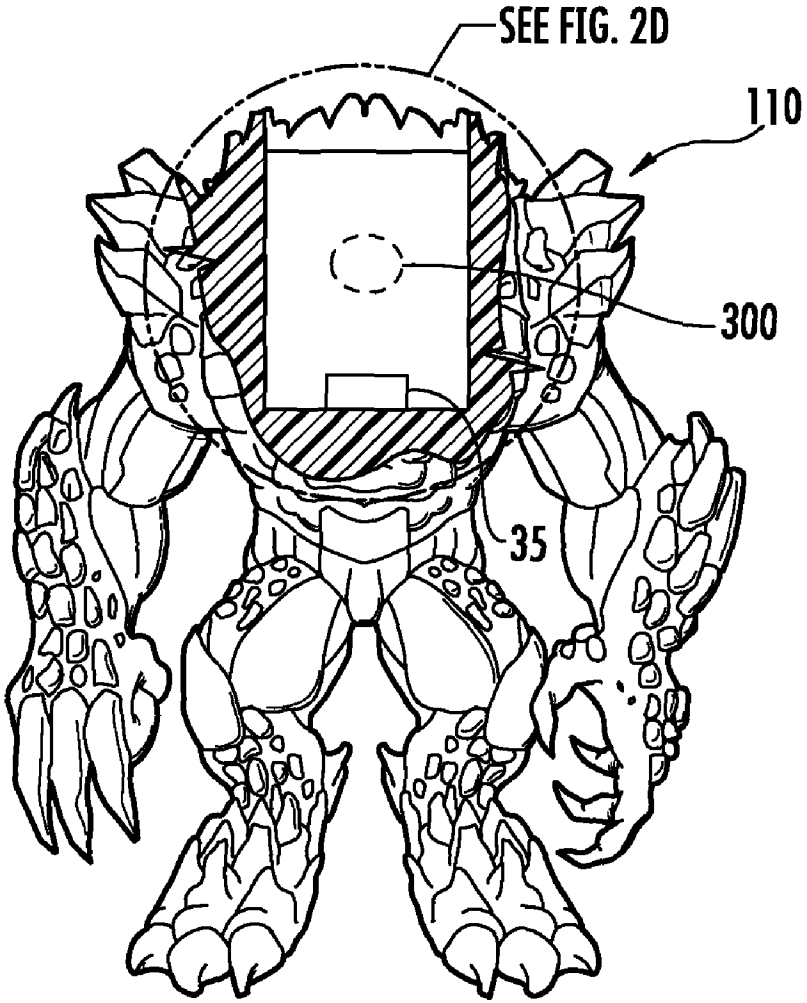
FIG. 2*c* is a partial section view of the device disclosed in FIGS. 2*a*, 2*b;*
Figure 3B:
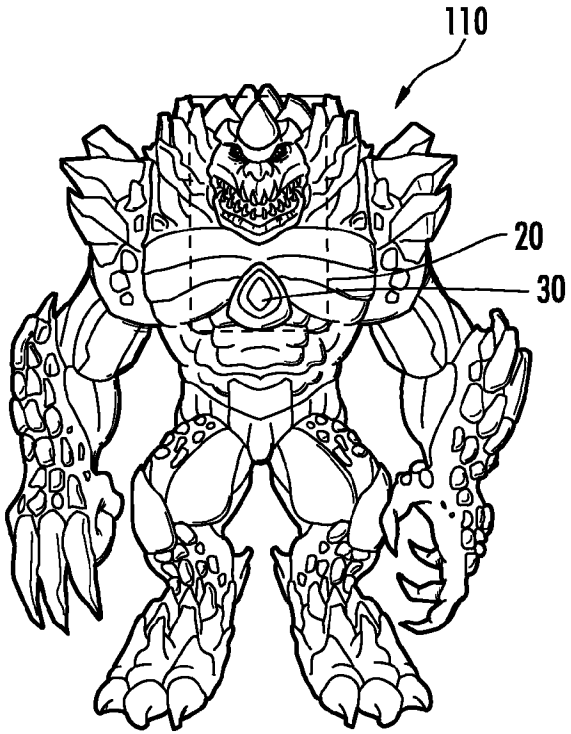
FIG. 3*b* is a front view of an embodiment of the game system.
Figure 3A:
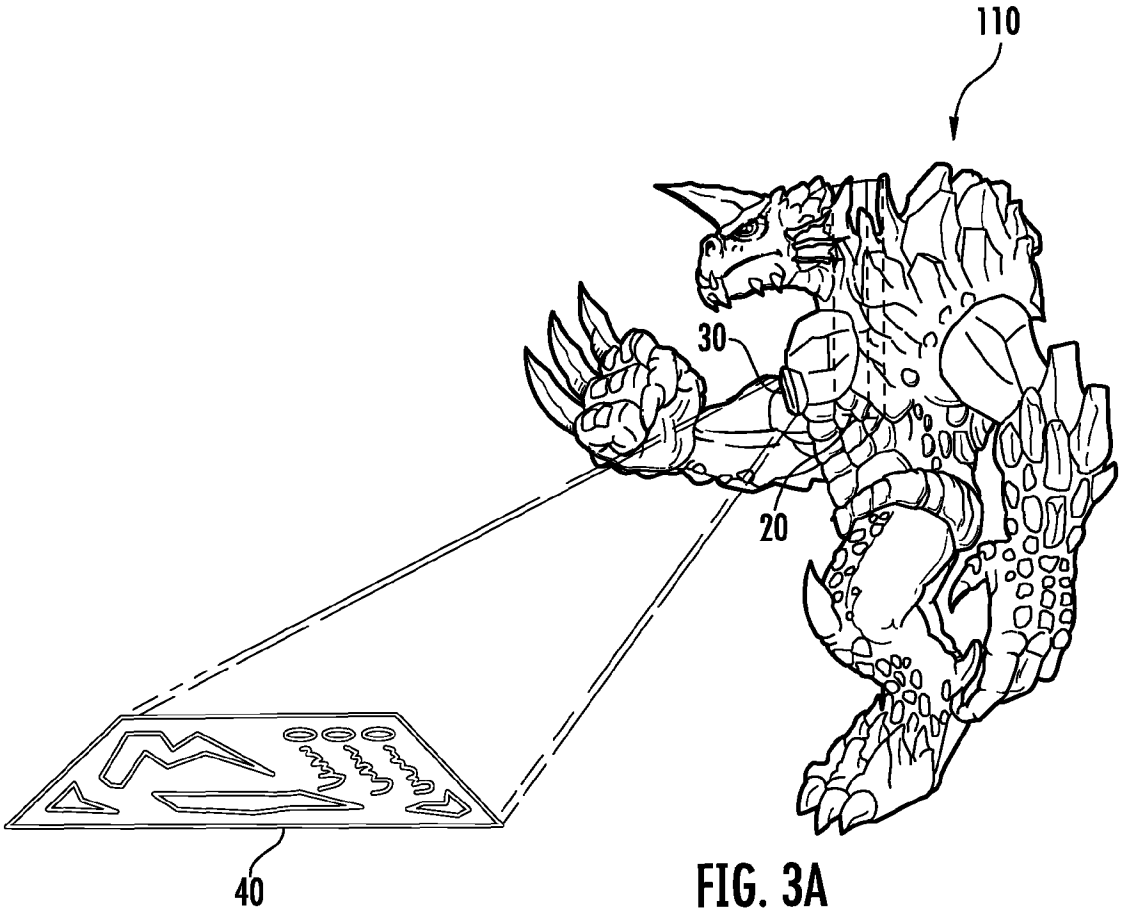
FIG. 3*a* shows the game system in use.

As shown in FIGS. 2*a* and 2*b*, the display device 110 is configured in the form of a figurine and comprises a slot 15 that readily receives the game piece 20. The term figurine can be understood to encompass: dolls, mannequins, action figures, robots, or the like. FIG. 2*c* is a partial cutaway of the display device 110. FIG. 2*d* is a detail view of a portion of FIG. 2*c* and schematically shows a light source 300 which is activated by the game piece 20 making contact with actuator 35. When the game piece 20 is inserted into slot 15 and contacts the actuator 35, light source 300 is activated acting as a projector, projecting light through the game piece 20 and the indicia or images 25 contained thereon and through aperture 30 creating a projection image 40 of the game information onto a playing surface. The aperture 30 can comprise a lens that can be adjusted to focus the projection image 40. The indicia or images 25 are of such a size that it is not readily legible by the naked eye. Thus, the display device 110 is required to project the game information 40 onto a playing surface.

Figure 4:
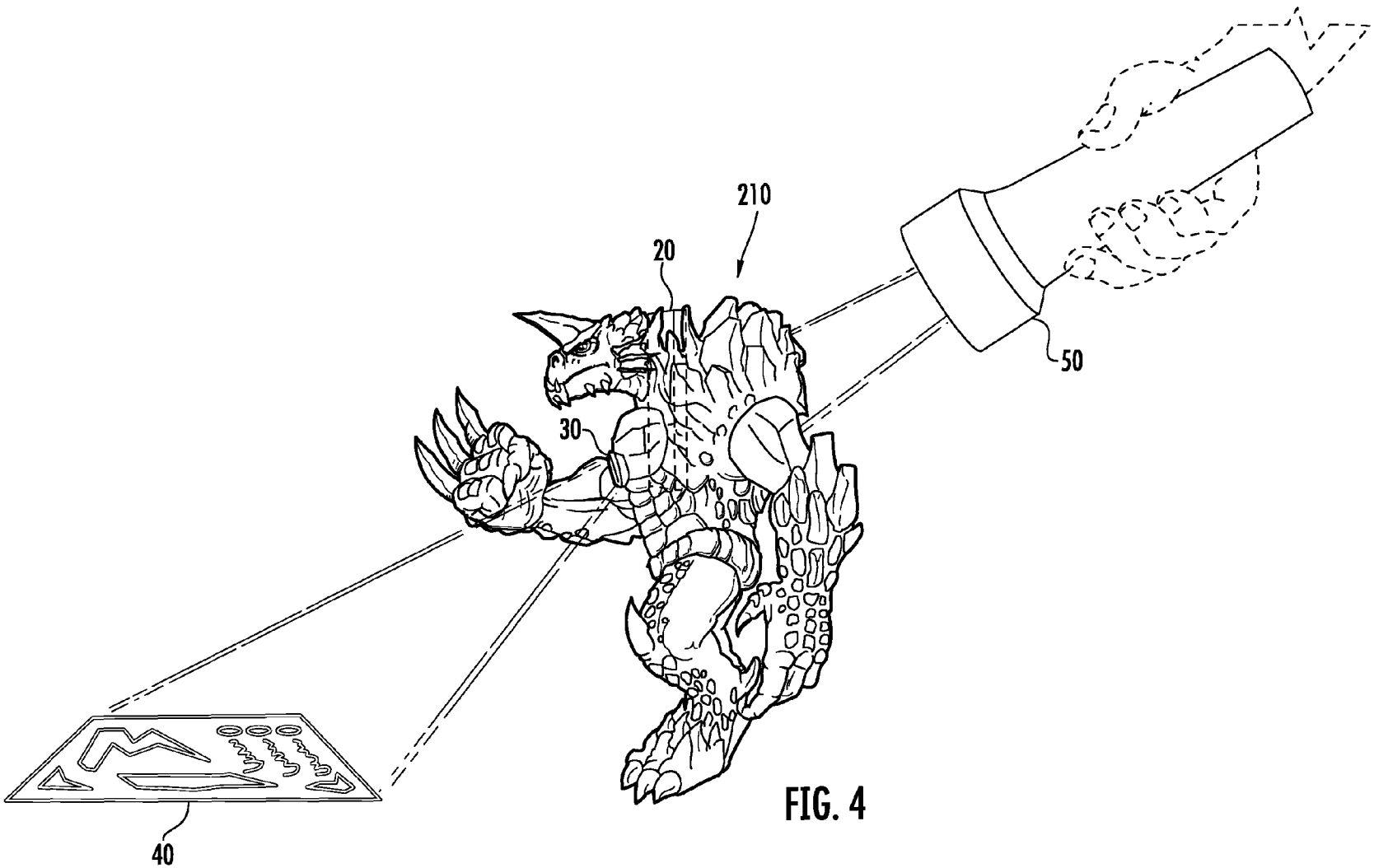
FIG. 4 is a side view of a second embodiment of a game system in use.

In an alternate embodiment shown in FIG. 4, the device 210 is configured to allow an external light source 50 to shine through the game piece creating the projection image 40 containing game information onto a playing surface. It is noted that the light sources 50, 300 required to project the game information onto a playing surface can be varied according to the type of game piece or playing surface being used, i.e., black light, infrared, various colored lights, etc. The different types of light can be used to show different game information contained on the same game piece 20.

Figure 5:
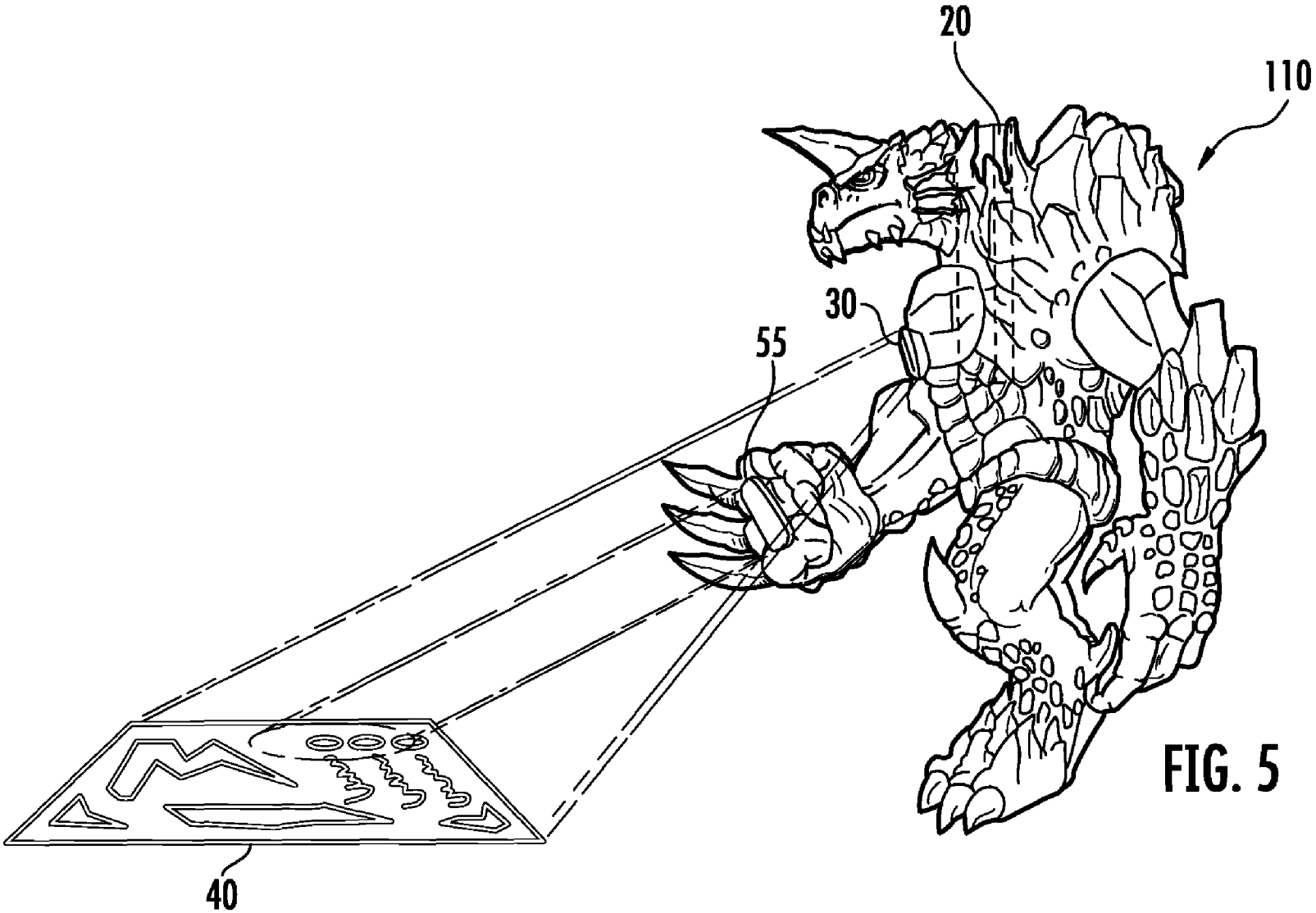
FIG. 5 is a variation of the embodiment shown in FIG. 3 in use.

Shown in FIG. 5, the game device 110 includes a secondary light source 55. This light source can be selectively activated to show hidden indicia or images on the game information projection 40. The secondary light source can be configured to only be effective in combination with the initial internal light source 300. Further, the secondary light source 55 can also be used to prevent a competitor from viewing vital game information when the game is played head to head. Alternatively, the secondary light source 55 can be used to affect the data on the sheet being projected, e.g. draw a circle on certain parts to affect the gameplay, change the color of the data etc. Several game pieces 20 can be combined in connection with each other by one or more devices, and thereby create an interaction between the data on such game pieces for gameplay purposes.

Figure 6:
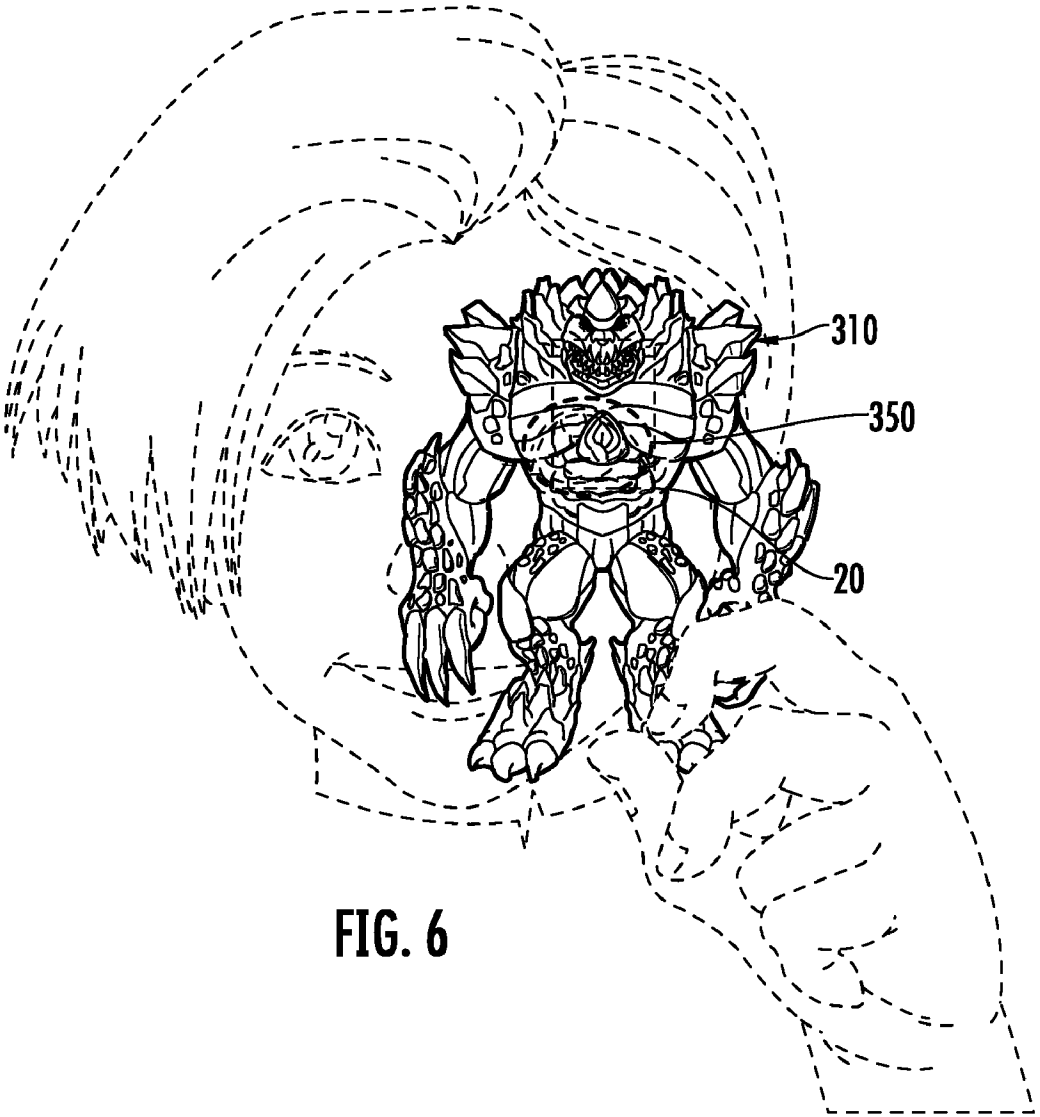
FIG. 6 is a further embodiment of the game system shown in use.

In a further embodiment shown in FIG. 6, the game device 310 includes an aperture 350 having a lens, which allows a player to visualize the indicia or images 25 on the game piece 20. The player looks through the aperture 350 while holding the game device up to a light source, i.e. sunlight, indoor lighting, etc. It should be noted that the game piece 20 can be configured to only provide visual indication of the indicia or images 25 under certain lighting conditions, i.e., a predetermined threshold of lumens, specific colored light, sunlight, infrared, black light, etc. Further, other devices to enhance the function of projecting light can be used, such as dark, polarizing or 3D glasses, to increase the contrast between the lit up information and the surroundings.

The game piece 20 can be configured to be part of a game system or can also be part of a trading card collection, and could also be included in give-away or promotional items. Alternatively, the game information can be printed from a laser or ink jet printer onto a transparent substrate, e.g. paper, printable film, plastic, etc. For example, the information can be downloaded from a central website, printed by a laser, ink jet or other suitable printer onto a transparent or semi-transparent substrate up to the appropriate size, mounted onto a blank game piece and placed in the game device 10, 110, 210, 310. Furthermore, the game pieces could also be part of a product label providing promotional value for the product being sold. In addition, the game device 10, 110, 210, 310 can simply be an individual collectable item used in individual creative playing and not part of any gameplay.

In a gaming situation, as shown schematically in FIG. 1, two game devices 10 are arranged opposite one another with a playing screen or projection surface 45 arranged between them. Each player inserts a game piece 20 into the game device 10, projecting indicia or images onto the game surface 45. In the arrangement shown in FIG. 1, the game information 40 is visible to both players, however it should be noted that the information will be backwards to one of the players. Generally the player projecting the information from the game piece 20. It should be noted that the projection surface 45 can be of such a material where the projection of the game information 40 is only visible to the player projecting it or displaying it.

In game play with game devices 10, 110, 210, 310, it should be noted that the game play can be configured as head to head, part of a quest, i.e., group play towards a common goal, or can be of an individual nature. In group play, the game pieces can contain complete or partial information. In the scenario where the game pieces contain partial information, the information provided is of such a nature that a second game piece is required to complete all the information required for the next step of the quest. The game device 10, 110, 210, 310 can be configured to receive a plurality of game pieces so the pieces having partial game information can be combined in the game device. Alternatively they can be configured to receive only one game piece at a time, thereby requiring overlaying of the projected game information 40. Furthermore the game devices 10, 110, 210, 310 can be configured to only receive specific game pieces 20. The game devices can have a specific configuration that will only receive game pieces having a specific conforming configuration or size. The device can also include a data storage device in order to store information contained on the game piece 20 that is inserted during a game.

The projection surface 45 need not be of a plain design; rather it can contain partial game indicia or images, which are completed upon projection of the game information 40 from the game pieces 20. The projection surface can be configured as a board having positions for projecting partial or game information 40.

In a further alternate embodiment, the game devices 10, 110, 210, 310 can be configured to project the game information of the game piece 20 into a web camera of a computer that is connected to the internet for remote game play with multiple opponents. For example, the projected game information 40 can be projected onto a surface that is viewable by a webcam that is connected to a computer, that is connected to the internet, and transmit the information or the image of the game information 40 to a central server which thereby coordinates a response or an appropriate determination of a next step as part of the game being played.

It is noted that the game device can be configured to be a figurine that contains the game piece already included therein. In such an embodiment, a plurality of game pieces can be preloaded, where one set contains images or indicia in different positions, and one set with images or indicia in different locations, e.g. background and foreground.

The figurine includes a plurality of semi-transparent game pieces containing indicia or images thereon. The figurine includes a rotatable portion and an aperture configured for viewing or projecting the indicia or images. The plurality of game pieces includes at least first and second sets. The first set includes indicia or images in various positions and the second set comprises indicia or images in various locations. When the rotatable portion is rotated in a first direction the indicia or image of the first set that is viewable or projected is changed and when the rotatable portion is rotated in a second direction, opposite the first direction, the indicia or image of the second set that is viewable is changed. This allows for a multiple combinations of images, e.g. 64 combinations of pictures, if 8 locations and 8 positions are present, 82 combinations if 9 locations and 9 positions are present, etc. Alternatively, a similar feature is achieved by changing the light or changing the position of an indication arrow that points to certain information on the game piece and thereby affecting gameplay.

While the present invention has been described in connection with the various embodiments and figures, it is understood that other similar embodiments may be used or modifications and additions made to the described embodiments for performing the same function of the present invention without deviating therefrom. Therefore, the present invention should not be limited to any single embodiment, but rather should be construed in breadth and scope in accordance with the recitation of the appended claims.

What is claimed is:

1. A game system comprising at least one game device and at least one game piece, wherein the game piece comprises game information that is not readily legible to the naked eye, and is projected by the game device onto a game surface, wherein the game piece comprises indicia or images thereon; the at least one device further comprising a rotatable portion and an aperture configured for viewing or projecting the indicia or images, and wherein the at least one device is configured as a figurine.

2. The game system of claim 1, wherein the game device is configured to receive a game piece containing game information thereon and projects light onto the game piece, thereby projecting the game information contained thereon onto a playing surface.

3. The system of claim 2, wherein the device is configured to only project when the game piece is inserted therein.

4. A device for playing a game that is configured to receive a game piece that is at least semi-transparent and contains information thereon that is not readily legible to the naked eye, the device comprising a black light, infrared, or filtered internal light source that is actuated when a game piece is inserted into the device, the light source shining light through the game piece thereby projecting the information contained thereon.

5. The device of claim 4, wherein the device is configured as a figurine.

6. A device for playing a game that is configured to receive a game piece that is at least semi-transparent and contains information thereon that is not readily legible to the naked eye, wherein the semi-transparent game piece comprises indicia or images thereon; the device further comprising a rotatable portion and an aperture configured for viewing or projecting the indicia or images, and wherein the device is configured as a figurine.

7. The game piece of claim 6, wherein the game information is preprinted on the game piece.

8. The game piece of claim 6, wherein the game information is printed by a player.

9. The game piece of claim 6, wherein the game piece is comprised in a label.

10. The game piece of claim 6, wherein the game piece is packaged with another product.

11. The game piece of claim 6, wherein the game information is downloadable and printable by a player.

12. The device of claim 6, wherein the game piece includes at least first and second sets, the first set comprises indicia or images in various positions and the second set comprises indicia or images in various locations.

13. The device of claim 12, wherein when the rotatable portion is rotated in a first direction the indicia or image of the first set that is viewable or projected is changed.

14. The device of claim 13, wherein when the rotatable portion is rotated in a second direction, opposite the first direction, the indicia or image of the second set that is viewable is changed.

* * * * *